US005697133A

United States Patent [19]

Reber et al.

[11] Patent Number: 5,697,133

[45] Date of Patent: Dec. 16, 1997

[54] METHOD AND APPARATUS FOR BASTING QUILTS OR THE LIKE

[76] Inventors: James K. Reber; Jill A. Reber, both of 10481 NW. 107th Ave., Granger, Iowa 50109

[21] Appl. No.: 294,001

[22] Filed: Aug. 22, 1994

[51] Int. Cl.[6] ..... B68G 15/00

[52] U.S. Cl. ..... 29/91; 29/281.1; 227/140; 227/154; 269/293

[58] Field of Search ..... 29/914, 281.4, 29/432, 281.1, 91, 91.2; 33/1 G, 1 K; 273/451, 453; 112/117, 118, 119; 248/346.03; 269/293, 294, 295; 108/50, 901; 227/140, 154, 155; 83/941, 953

[56] References Cited

U.S. PATENT DOCUMENTS

| | | | |
|---|---|---|---|
| 245,149 | 8/1881 | Fowler | 269/293 X |
| 281,826 | 7/1883 | Bledsoe | 112/119 |
| 288,660 | 11/1883 | Prator | 112/119 |
| 338,601 | 3/1886 | Ketcham | 269/295 X |
| 453,350 | 6/1891 | Stukes | 112/119 |
| 543,218 | 7/1895 | Orr | 29/91.4 X |
| 569,947 | 10/1896 | Adler | 269/295 X |
| 599,388 | 2/1898 | Huff et al. | 112/119 |
| 661,302 | 11/1900 | Bernhardt et al. | 29/91.4 |
| 680,147 | 8/1901 | Hollatz | 29/91.4 |
| 691,937 | 1/1902 | Freschl | 227/154 X |
| 1,034,766 | 8/1912 | Buser | 29/91.4 |
| 2,923,452 | 2/1960 | Holovka | 269/293 X |
| 3,276,112 | 10/1966 | Tautunger et al. | 29/432 |
| 3,652,087 | 3/1972 | Carmen | 273/453 |
| 3,747,929 | 7/1973 | Burke | 273/DIG. 19 X |
| 4,346,884 | 8/1982 | Warehme | 273/451 |
| 4,416,407 | 11/1983 | Bone . | |

*Primary Examiner*—Joseph M. Gorski
*Attorney, Agent, or Firm*—Henderson & Sturm

[57] ABSTRACT

A method and apparatus for basting layers of flexible materials together such as for quilt making includes a spacing member, such as a grid, having openings therein is disposed on a support surface. A backing member or first flexible member is operatively secured to the support surface and a second member disposed over the first flexible member. Other layers are then placed over the second flexible member and, in the case of quilt making, there would typically be just three layers. A basting gun having a hollow needle is then utilized by pushing the hollow needle through all of the layers of flexible material and into one of the openings in the spacing member. Then the basting tool is utilized to force the first end of the plastic fastener through the hollow needle so that this first end of the plastic fastener is on one end of the flexible members and the second end of the plastic fastener is on the other side of the flexible members whereby the flexible members are held together by the plastic fastener. This process is repeated at various places on the flexible layers until they are held together sufficiently so that they can be permanently sewn together.

4 Claims, 3 Drawing Sheets

METHOD AND APPARATUS FOR BASTING QUILTS OR THE LIKE

TECHNICAL FIELD

The present invention relates generally to a method and apparatus for basting quilts and more particularly to such apparatus which utilizes a basting gun which has a hollow needle and plastic fasteners wherein one end of the plastic is forced through the hollow needle to the other side of a flexible member such as pieces of cloth. The present invention further relates to an accessory for use with such a basting system which has a spacing apparatus for receiving the needle and preventing it from being damaged during the operation of the basting gun.

BACKGROUND ART

Quilt making is a craft which has been practiced for many decades, but which seems to become more popular as time goes on. Generally, quilts consist of a backing member, a decorative face and a batting or filling between the backing and decorative face. In order for the quilt to be properly constructed, these three layers need to be held together while the three layers are then sewn together in a more permanent fashion. This method of holding the layers together while the sewing occurs is commonly referred to as basting.

One of the first basting methods used in North America in the early twentieth century was to secure a backing member to a support surface such as a floor or a table. Then the batting is placed on top of the backing and the decorative face is placed on top of the batting. Then needles were used to take long stitches through all three layers beginning at the center of the three layers and proceeding outwardly until the basting process is complete. This was a difficult and time-consuming task and required considerable skill.

Another basting method began the same way, but instead of using long stitches with needle and thread, safety pins were used to hold the three layers together to complete the basting process. The problem with the safety pins is that they rust and stain the material because quite often the process of stitching the three layers together is quite a long time-consuming process, especially if done with hand stitching rather than machine stitching. Consequently, the safety pins would remain in place for long periods of time and through changes of weather which may cause rusting or the like.

After the development of a gun of the type used to apply price tags to clothing in retail outlets, it became a practice to use this type of basting tool to hold the three layers of a quilt together by using the hollow needle and basting gun to first stick the hollow needle through the three layers and then pull the trigger on the gun which forces one end of a plastic fastener to move through the needle and be disposed on the side of the three layers adjacent the free end of the needle while the other end of the plastic fastener remains on the side of the quilt nearest the person using the basting gun. The only real difference in this process between applying a price tag to a piece of clothing and basting is that typically the plastic fasteners are much shorter because it is desired to hold the three layers of cloth closely together.

Using the basting tool then became a problem to baste from the center first and then go outwardly because sticking the needle through the cloth caused the needle to stick into the floor or table which was being used as a supporting surface for the layers. Unless the free end of the needle extends completely through all three layers, the plastic end would not be properly placed through all three layers either. Consequently, it was a practice by some to stick the needle straight downwardly until it hit the supporting surface and then to tilt the basting tool to one side and continue to push on the basting needle so that it would go in at an angle, such as 45° or 60°, and the end of the needle would move along the supporting surface to ensure that the needle was through all three layers before the plastic fastener was inserted. This caused a great deal of damage to the needles and turned out to be an expensive problem when needles needed to be replaced. It could also damage the supporting surface such as hardwood floor or table.

Another solution to the problem was to eliminate the step of securing the backing member to the supporting surface and to merely start from one end and manually lift up the three layers, stick the needle through the three layers and then actuate the basting gun to apply the plastic fastener. Then the three layers of the quilt would just be rolled up from one end as this process is completed. A major problem with this type of basting process is that the three layers are not held in the proper relationship with one another, since it is quite preferable to having the backing layer completely stretched out at all times during the basting process.

Consequently, there is a need for a better solution to the problem of how to use a basting tool of the type that applies plastic fasteners, while still being able to keep the backing member stretched during the basting process, and to be able to begin the basting process at the center and move outwardly rather than being forced to start from one end of the three layers and baste from one end to the other or one side to the other.

DISCLOSURE OF THE INVENTION

The present invention relates generally to a method and apparatus for basting layers of flexible materials together such as for quilt making. A spacing member, such as a grid, having openings therein is disposed on a support surface. A backing member or first flexible member is operatively secured to the support surface and a second member disposed over the first flexible member. Other layers are then placed over the second flexible member and, in the case of quilt making, there would typically be just three layers. A basting gun having a hollow needle is then utilized by pushing the hollow needle through all of the layers of flexible material and into one of the openings in the spacing member. Then the basting tool is utilized to force the first end of the plastic fastener through the hollow needle so that this first end of the plastic fastener is on one end of the flexible members and the second end of the plastic fastener is on the other side of the flexible members whereby the flexible members are held together by the plastic fastener. This process is repeated at various places on the flexible layers until they are held together sufficiently.

In one embodiment of the present invention, the spacing member is movable from place to place and has cords which allow the user to pull spacing member to whatever place is desired underneath the layers of flexible material and between the bottom layer of flexible material and the supporting surface.

Another aspect of the invention has flexible cords which are adjustable in length so that they can be used in a shortened condition in most instances for convenience purposes, but when it is needed to use the flexible members on a large quilt or the like, the flexible members can be quickly lengthened to the needed length.

An object of the present invention is to provide an improved method and apparatus for basting layers of flexible materials together, such as for quilt making.

Another object of the present invention is to provide a method and apparatus which allows the use of a basting tool which applies plastic fasteners but prevents the bending or damaging of the hollow needles used in such basting tool while at the same time permitting the backing member to be held tight and taut during the process.

A still further object of the present invention is to provide an accessory for spacing the lower backing member between the support surface and providing an opening to receive the needle of the aforementioned type of basting tool.

A still further object of the present invention is to provide such a spacing member which is small enough to be convenient but which can be moved easily underneath the backing member even when it is secured tightly to a support surface so that it moves between the backing member and the support surface.

Other objects, advantages and novel features of the present invention will become apparent from the following detailed description of the invention when considered in conjunction with accompanying drawings.

BEST MODES FOR CARRYING OUT THE INVENTION

Figure 1:
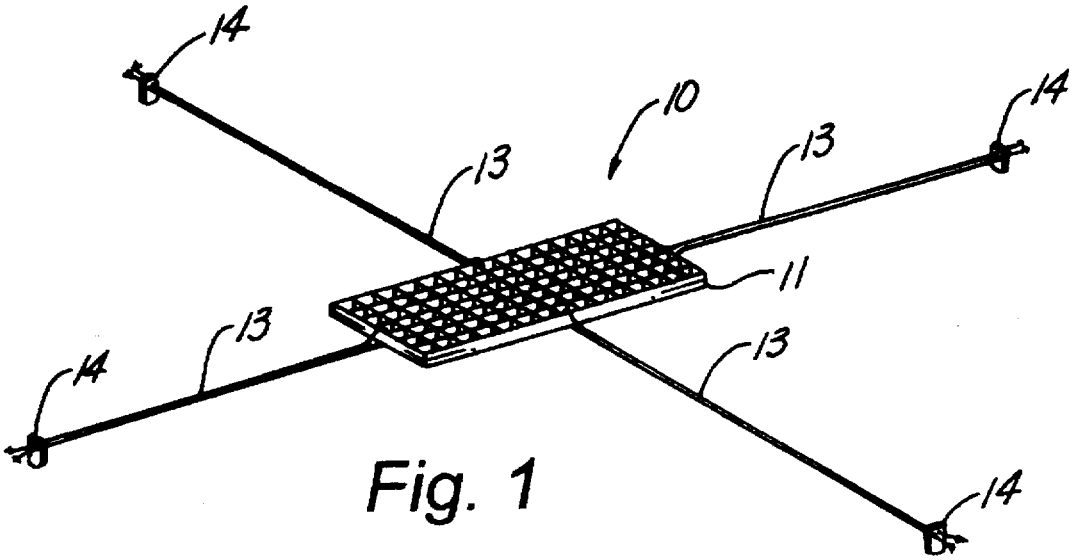
FIG. 1 is a perspective view of a preferred embodiment of the present invention shown with flexible cords stretched out in their shortened form.
Figure 2:
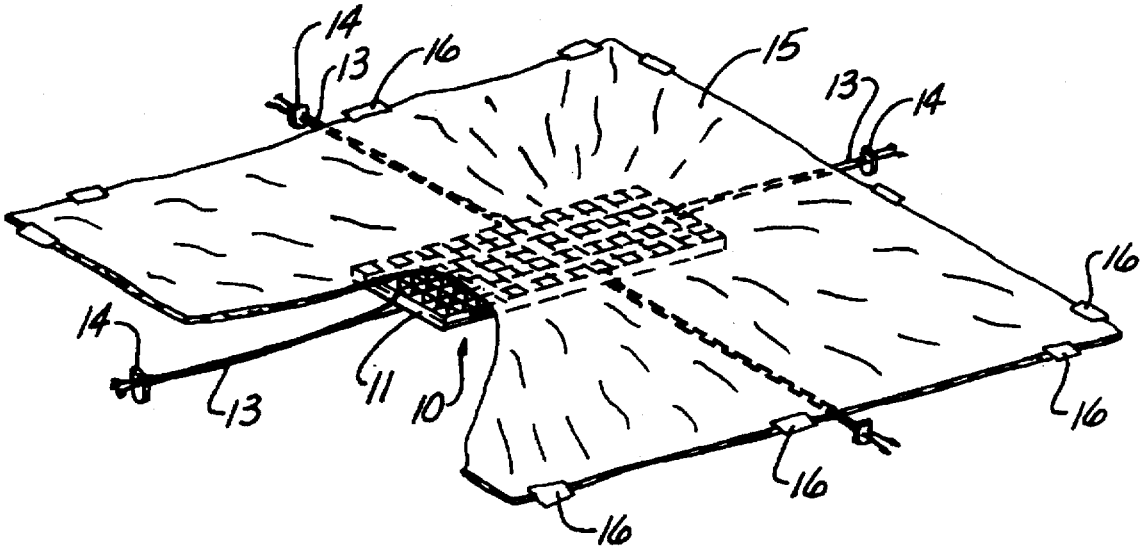
FIG. 2 is a perspective view of the present invention like FIG. 1 but showing the backing material of a quilt in the process of being constructed whereby it is taped to a supporting surface such as a floor and having a portion thereof broken away to show one edge of the accessory of one end of the present invention.
Figure 3:
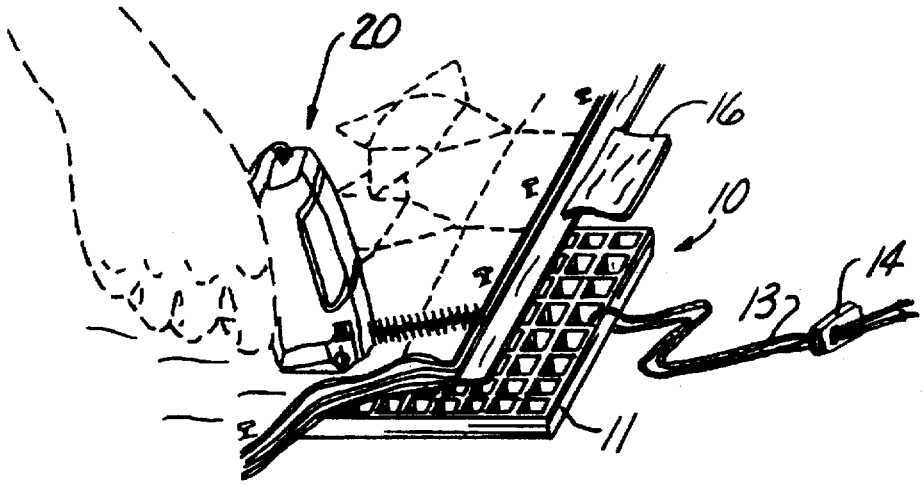
FIG. 3 is a perspective view of the present invention and shows how three layers of a quilt can be basted together using a basting tool of a type which inserts plastic fasteners through the layers.

Referring now to the drawings wherein like reference numerals designate identical or corresponding parts throughout the several views, FIG. 1 shows a spacing apparatus (10) constructed in accordance with the present invention which is essentially a grid having walls (11) and openings (12) disposed between the walls (11). A cord (13) is attached to each side and end of the spacing device (10) by merely looping one end of each cord (13) around through one of the openings (12) and around one of the walls (11) forming a double rope out to cord locks (14) which are disposed on each end of the cords (13).

Figure 4:
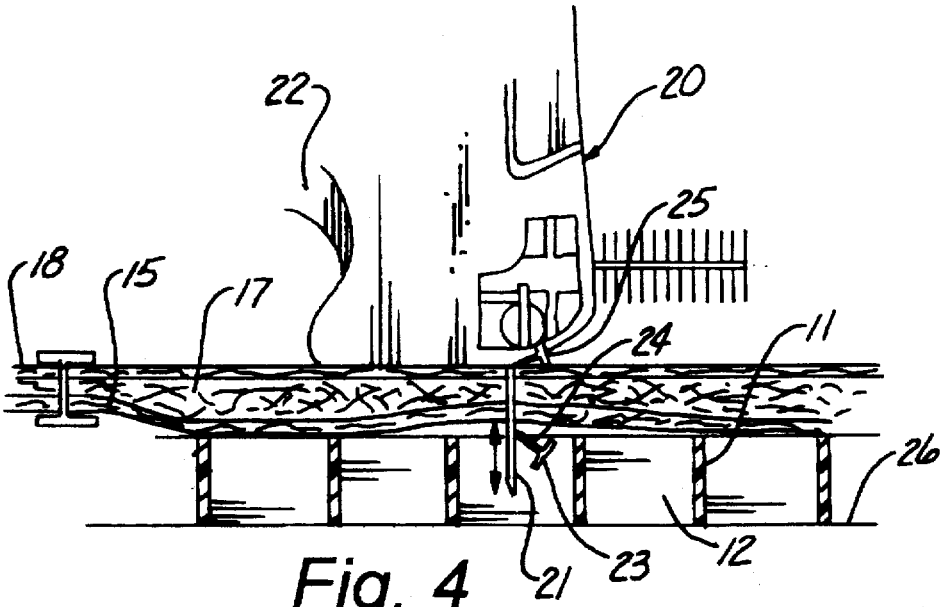
FIG. 4 is a cross-sectional view of FIG. 3 near where the needle extends through the three layers and showing how the plastic fasteners are inserted and how the needle extends into the spacing device which faces the three layers of the quilt above the supporting surface.
Figure 5:
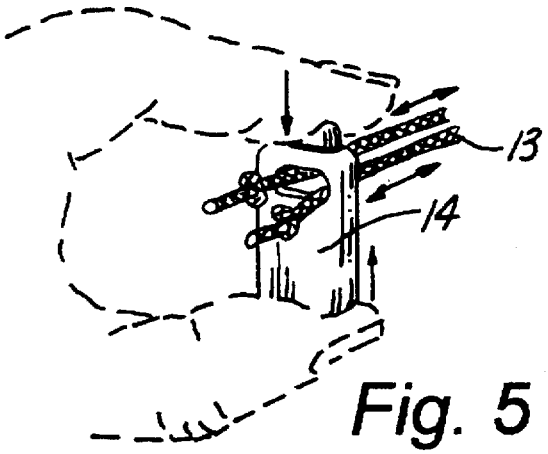
FIG. 5 is a perspective view of a cord lock device of a type which will securely hold two cords together in its normal condition because it has a spring therein pushing a member against the two cords.
Figure 6:
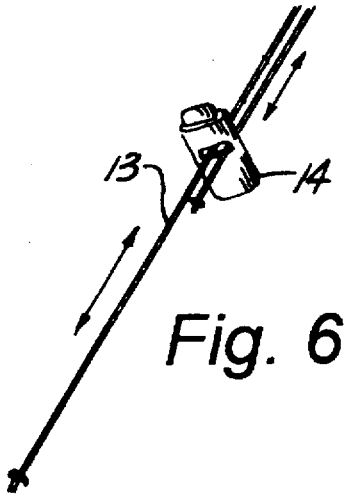
FIG. 6 shows how, if the button on the cord lock is pushed, the cords are free to move and be adjusted until released.

On a large surface, such as a floor or table, a spacing member (10) is placed, such as shown in FIG. 1, adjusting the cord locks (14) to extend just beyond the outside edge of the quilt so that they are as short as possible while still being of sufficient length. A backing member (15) is taped to the floor or other supporting surface to keep the backing member tight. Masking tape (16) or duct tape or the like can be utilized. Referring now to FIG. 4, it is noted that after the backing member (15) is secured in place that a batting or filling (17) is laid on top of the backing (15) and a decorative top (18) is then placed on top of the batting (17).

Then the basting gun (20), which is of a type which is commonly in usage and can be of the type shown in U.S. Pat. No. 4,416,407 to Bone, issued on Nov. 22, 1983, and which is incorporated herein by reference, is utilized and has a hollow needle (21) and a plunger which operates in response to a trigger (22) to push one end (23) of a plastic fastener (24) through the three layers (15), (17) and (18). The other end (25) of the plastic fastener (24) extends on the top side of the three layers and the other end (23) extends on the lower side of the three layers of material. It is noted that if no spacer (10) was provided that the needle (21) would push directly against the supporting surface (26) and might not extend through the bottom layer (15) sufficiently so that the one end (23) is completely below the layer (15). Otherwise, if the portion (23) is ejected above the layer (15) then the basting process would not be properly accomplished.

Figure 7:
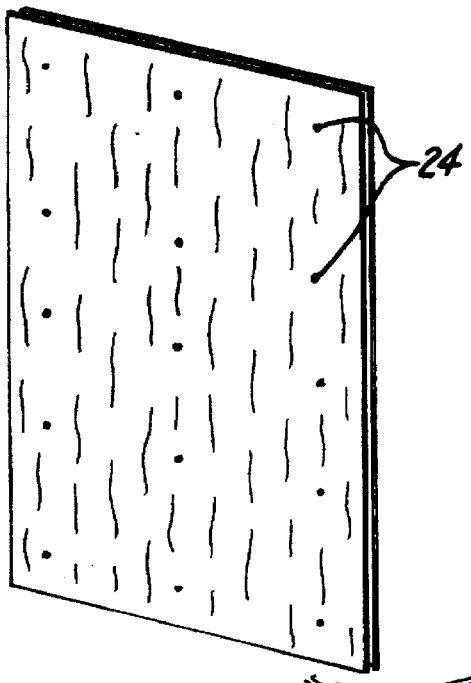
FIG. 7 shows a perspective view of a quilt which has been basted sufficiently to hold the three layers together so that it can be sewed together permanently.
Figure 8:
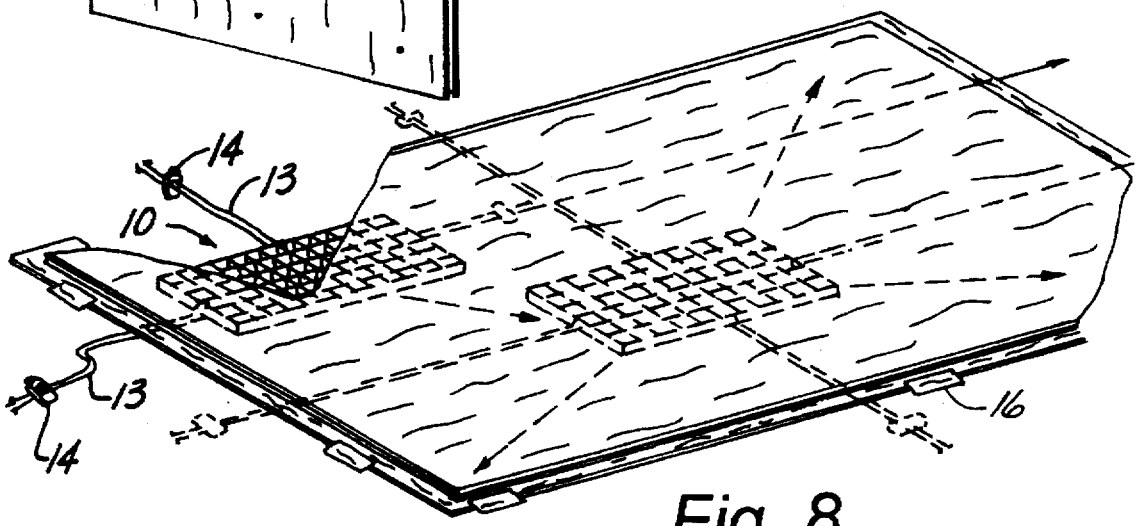
FIG. 8 is a perspective of the present invention and showing the spacing device in dashed lines under three layers of cloth and how it can be moved to other positions by pulling on one or more of the cords associated therewith.

The three layers are then basted together everywhere that is desired, for example in all of the places where fasteners (24) are shown in FIG. 7. This is done by selectively pulling on the cords (13) to be sure the grid (11) is disposed under the portion of the three layers where the needle (21) is to be asserted therethrough. If a very large quilt is being construction, for example a king size quilt which is 12 feet across, the cord locks (14) would be utilized to convert to double the length of the cords from the length they would be in FIG. 1. That way the user can pull it completely to one side of the quilt and still be able to pull it back to the other side of the quilt without reaching under the backing member (15), which would cause it to loose its tautness.

Figure 9:
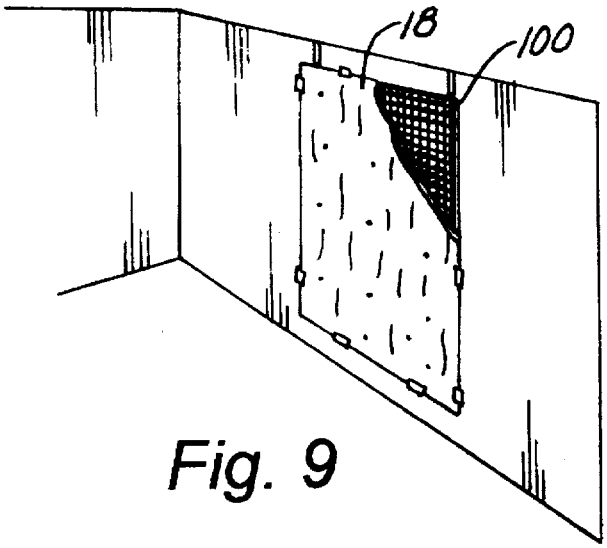
FIG. 9 shows a spacing device formed of a grid which covers the entire area where the three layers of cloth are to be basted so that it is not necessary to move the grid underneath the three layers of cloth.

Referring to FIG. 9, it is noted that the grid (100) is essentially just like the grid (10) only it is much larger. For example, it could cover an entire wall or an entire floor or it can just cover part of a wall such as that shown in FIG. 9, but so that it is at least as large as the three layers which have merely been labeled with the number (18) designating the outer layer thereof. But using the embodiment of FIG. 9, the needle (21) of the basting gun (20) can be used anywhere on the layers of flexible material because there is always a space (12) below in the grid (100) to receive the needle (21).

Accordingly it will be appreciated that the preferred embodiments shown herein do indeed accomplish the aforementioned objects. Obviously many modifications and variations of the present invention are possible in light of the above teachings. It is therefore to be understood that, within the scope of the amended claims, the invention may be practiced otherwise than as specifically described.

We claim:

1. An apparatus in combination with a plurality of stacked layers of flexible material while the layers are on a supporting surface in preparation for further steps in a quilt making process, said layers of material having edges, said apparatus comprising:

a hollow compartmentalized spacing means, disposed beneath a portion of the bottom layer of material and on top of said supporting surface for providing a compartmentalized space between said supporting surface and said bottom layer of material for receiving a hollow needle after the needle pierces said layers of material when moving toward said supporting surface; and an elongated tether operatively attached to each side of the exterior periphery of said spacing means for selectively moving said spacing means relative to said layers of material and along said supporting surface.

2. The apparatus of claim 1 including fastening means for securing the edges of at least one of the layers of said material to said supporting surface.

3. The apparatus of claim 1 wherein each of said elongated tethers comprises a flexible line.

4. The apparatus of claim 3 including means for adjusting the length of each flexible line.

* * * * *